United States Patent [19]

Orndorff, Jr. et al.

[11] 4,114,556

[45] Sep. 19, 1978

[54] RIGID MOORING ARM HOOK-UP SYSTEM

[75] Inventors: James A. Orndorff, Jr., Glen Ellyn; Robert S. Wozniak, Elmhurst; John S. Andrepont, Lisle, all of Ill.

[73] Assignee: Chicago Bridge & Iron Company, Oak Brook, Ill.

[21] Appl. No.: 805,652

[22] Filed: Jun. 13, 1977

[51] Int. Cl.[2] ..... B63B 21/00

[52] U.S. Cl. ..... 114/230

[58] Field of Search ..... 9/8 R, 8 P; 114/293, 114/258, 259, 249, 250, 230; 141/387, 388, 279; 244/135 A

[56] References Cited

U.S. PATENT DOCUMENTS

| | | | |
|---|---|---|---|
| 3,408,576 | 9/1975 | van der Gaag | 114/230 |
| 3,426,719 | 2/1969 | Mizell | 114/230 |
| 3,442,245 | 5/1969 | Christians | 114/230 |
| 3,851,852 | 12/1974 | Blanchard | 244/135 A |
| 4,010,500 | 3/1977 | Reid | 114/230 |

*Primary Examiner*—Trygve M. Blix

*Assistant Examiner*—D. W. Keen

*Attorney, Agent, or Firm*—Merriam, Marshall & Bicknell

[57] ABSTRACT

A "quick-disconnect" rigid mooring system for attaching a ship to a buoyant tower comprises two rigid yoke structures, one of which is attached to the buoyant tower and the other of which is attached to the ship. Each yoke contains one element of a two-element "quick-disconnect" system, which when locked, achieves a rigid interconnection between the vessel and the buoyant tower. The yoke structures are provided with means which permit the structures to be properly aigned during the connect and disconnect procedures. The locking element of one of the yokes comprises an arm which projects from the end thereof, and a pair of transversely extending pins situated below the outwardly projecting arm. The locking element of the other yoke comprises a pair of spaced, parallel outwardly projecting arms provided with longitudinal slots that accept the outwardly projecting pins on the other yoke and guide the two yokes into aligned proximity, permitting the lock to be effected.

4 Claims, 7 Drawing Figures

RIGID MOORING ARM HOOK-UP SYSTEM

This invention relates to a rigid mooring system for use in attaching a floating ship or other vessel to a buoyant tower attached to the ocean floor. More particularly, the invention relates to a mooring system comprising two rigid yoke structures attached together with a "quick-disconnect" lock which maintains the structural rigidity of the system.

BACKGROUND OF THE INVENTION

It is sometimes desired to moor a floating ship or other vessel to a buoyant tower in an offshore location for extended or indefinite periods of time. A typical instance of such use arises in conjunction with the operation of an offshore oil well, in which oil from below the surface of the ocean rises through pipes connected to a buoyant tower and into a ship attached thereto. Instead of transporting the oil from the offshore location to a refinery, it has been proposed to moor to the buoyant tower a vessel which is in effect a floating refinery, which can be used to process the crude oil. In such cases, the floating refinery is intended to remain attached to the tower for long periods of time. In order to prevent damage to the ship or the buoyant tower, it is desirable to provide a rigid mooring arm connecting the ship to the tower. The rigid arm must be adequately strong to resist the forces exerted on it by the action of the wind, waves and tide and must at the same time permit the vessel to swing about the mooring point, as well as to roll and pitch. Further, it is desirable that the mooring arm permit the connection between the ship and the tower to be made or broken quickly without damage to either the tower or the ship. In view of the large size of the vessel typically used in such installations, the elements of the mooring system must be large and heavy to withstand the enormous forces which are encountered. The size and weight of the mooring system combined with the size of the vessel, the movement of which must be controlled during the connect and disconnect procedures, create severe problems in the design of a mooring system for insuring that connection and disconnection can be made without collision damage to either the vessel or the tower.

BRIEF DESCRIPTION OF THE INVENTION

In accordance with the invention, there is provided a rigid mooring system comprising two rigid yoke structures, one of which is attached to the buoyant tower and the other of which is attached to the ship. The yoke structures are provided with means which permit the structures to be properly aligned during the connect and disconnect procedures. Each yoke contains one element of a two-element "quick-disconnect" system, which when locked, achieves a rigid interconnection between the vessel and the buoyant tower. The locking element of one of the yokes comprises an arm which projects from the end thereof, and a pair of transversely extending pins situated below the outwardly projecting arm. The locking element of the other yoke comprises a pair of spaced, parallel outwardly projecting arms provided with longitudinal slots that accept the outwardly projecting pins on the other yoke and guide the two yokes into aligned proximity, permitting the lock to be effected.

BRIEF DESCRIPTION OF THE DRAWINGS

The invention will be better understood from the following detailed description thereof, taken in conjunction with the accompanying drawings in which.

DETAILED DESCRIPTION

Figure 1:
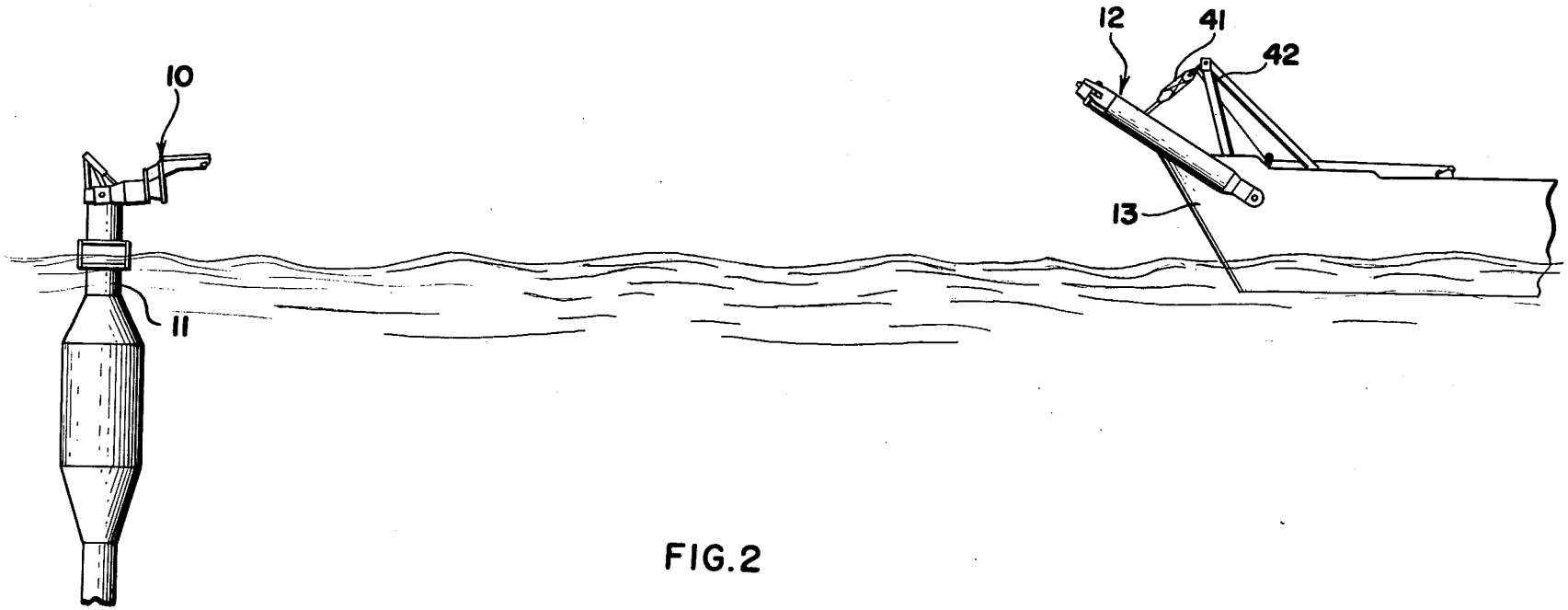
FIG. 1 is an elevation showing a floating ship provided with one element of the mooring system approaching a buoyant tower provided with the second element of the mooring system.

As shown in the drawings, the mooring system of the invention comprises two elements which can be connected and disconnected, as desired, to achieve or break a rigid mooring. These elements comprise a tower yoke assembly 10 connected to the top of a buoyant tower 11, the bottom of which is connected to the ocean floor, and ship yoke assembly 12 connected to the bow of a ship 13. Each of tower yoke 10 and ship yoke 12 has at its free end one element of a two-element "quick-disconnect" locking system which when actuated connects the yokes to form a rigid mooring arm.

Tower yoke assembly 10 comprises a generally U-shaped base member 14 (FIG. 7), the arms of which are rotatably connected by collinear pins 17 to the top of tower 11, thus permitting tower yoke assembly 10 as a whole to rotate about the horizontal axis of the pins. Rotation of tower yoke assembly 10 is controlled by one or more hydraulic rams 20, the function of which is to permit controlled rotation of base 14 around pins 17 as desired during attachment or detachment of ship 13 to the tower, and to support the weight of the tower yoke 10 after the ship is disconnected.

Attached to base member 14 is one element of the "quick-disconnect" system, consisting of a female alignment cone 18 and an outwardly projecting alignment arm 19 attached above the upper edge of cone 18, to the end of which is attached alignment arm wheel 21. Attached to the forward face of cone 18 at a location below alignment arm 19 are a pair of transverse collinear alignment pins 22. Female alignment cone 18 is attached to base 14 by conventional means which permits the cone and alignment arm 19 to rotate as a unit about a horizontal longitudinal axis.

Tower yoke assembly 10 is also connected to the top of tower 11 by a conventional rotary joint (not shown) which permits the entire tower yoke assembly to rotate about a vertical axis. Accordingly, it will be seen that when a ship is connected to the tower by means of the system of the invention, roll of the ship is permitted by the rotatable connection of female cone 18 to tower yoke base 14, pitch is permitted by rotation of base 14 about tower yoke pins 17, while the ship is permitted to swing about the buoyant tower by a rotatable joint between tower yoke assembly 10 and the top of tower 11.

Figure 7:
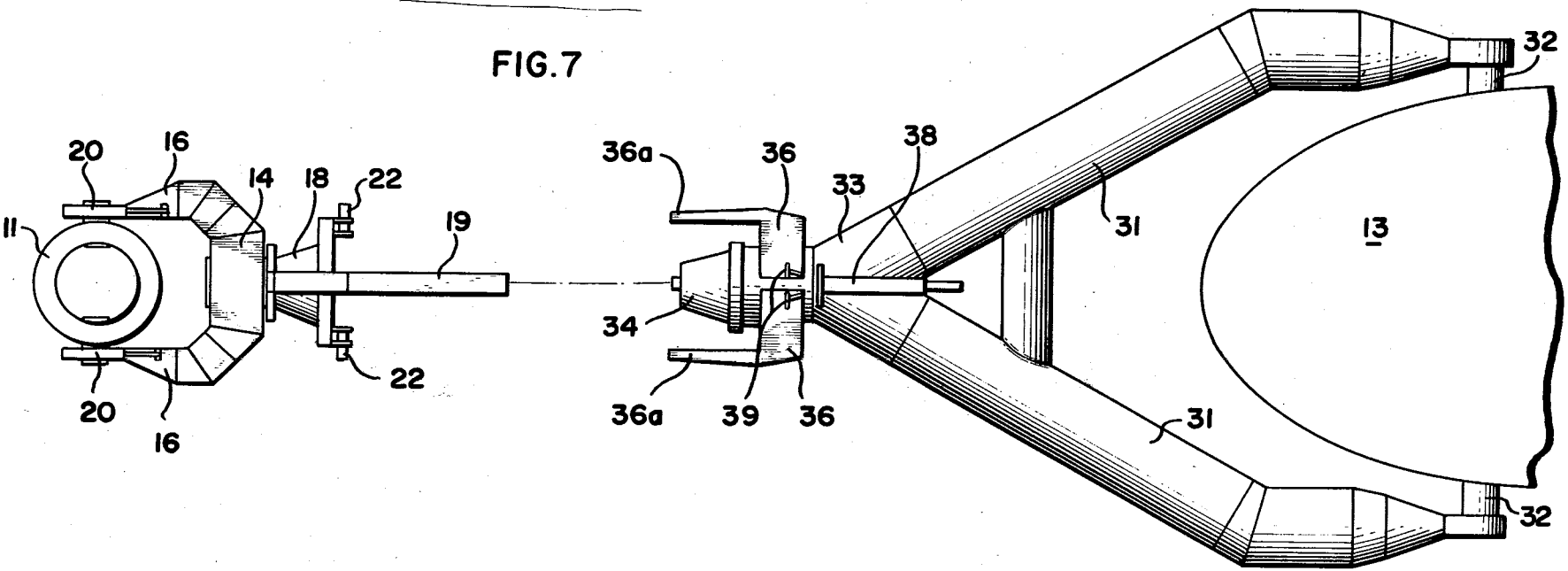
FIG. 7 is a plan view of the apparatus of the invention is a disconnected condition.

As shown in FIG. 7, ship yoke assembly 12 has a generally U or V-shaped configuration, comprising spaced arms 31, between which the bow of ship 13 is inserted, the free ends of the arms being connected to the ship by ship yoke pins 32 about which the yoke can pivot, while the other ends of arms 31 are connected together at the base 33 of the assembly. To base 33 of ship yoke assembly 12 is connected the second element of the "quick-disconnect" system, which locks with the corresponding element of the tower yoke to form a rigid mooring arm. The ship yoke disconnect element comprises a male alignment cone 34 adapted to nest and lock within female cone 18 of the tower yoke assembly 10. Spaced on either side of male cone 34 and projecting outwardly from the base 33 of the yoke are parallel alignment arms 36 which are preferably provided at their lower edges with rearwardly extending slots 37 of a size to receive alignment pins 22 of the tower yoke assembly. As shown, each slot 37 is defined by an upper member **36*a* and a lower member 36*b*. The length of upper member 36*a* is greater than that of lower member 36*b*, whereby the free end of member 36*a* overhangs the end of member 36*b*. As in the case of the tower yoke, the members of which the ship yoke assembly 12** is formed are of suitable size and strength to resist the forces encountered during operation of the assembly.

Attached to the top surface of base 33 and extending rearwardly from alignment arms 36 is an elongated bearing plate 38. Forward of the end of bearing plate 38 and spaced on either side thereof are a pair of vertical guide frames 39, the spacing between the guide frames being sufficient to accommodate the width of alignment arm 19 of the tower assembly.

The elevation of the base 33 of the ship yoke assembly is adjustable by means of block and tackle 41, one end of which is connected to ship yoke mast 42. The elevation of the free end of the ship yoke assembly can be adjusted by retracting or extending the free end 43 of ship yoke falls 44 in conventional fashion, as by means of a winch (not shown).

For operation of the mooring system, a connecting line 46 having a strength appropriate for the purpose is connected between the end of tower yoke alignment arm 19, passing through sheave 47 at the lower end of block and tackle 41 and sheave 48 in the bow of the ship 13, the free end passing to a conventional winch (not shown). It will be seen that by drawing on line 46, the ship can be made to approach the mooring station.

Figure 2:
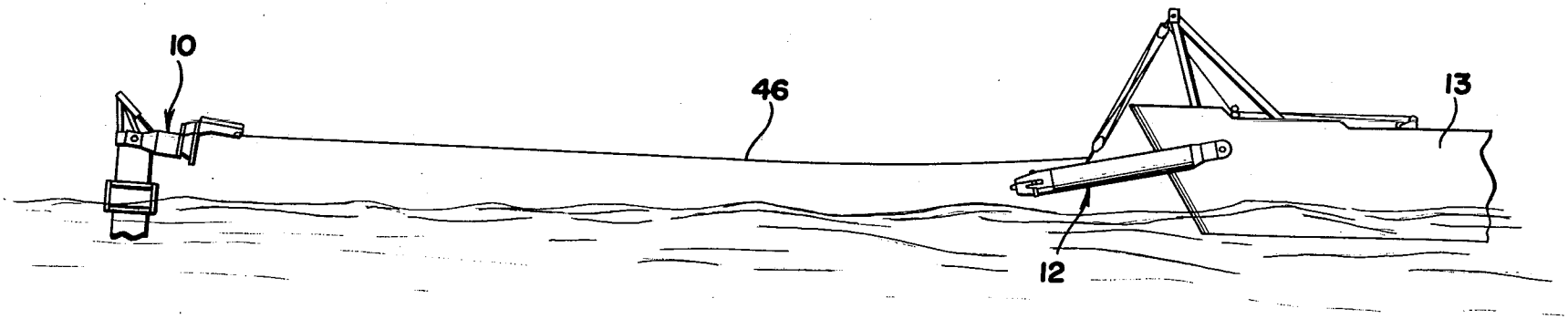
FIG. 2 shows the apparatus of the invention in use during the initial stages of a mooring operation, in which a cable attached to the tower is used to pull the vessel toward the tower.
Figure 3:
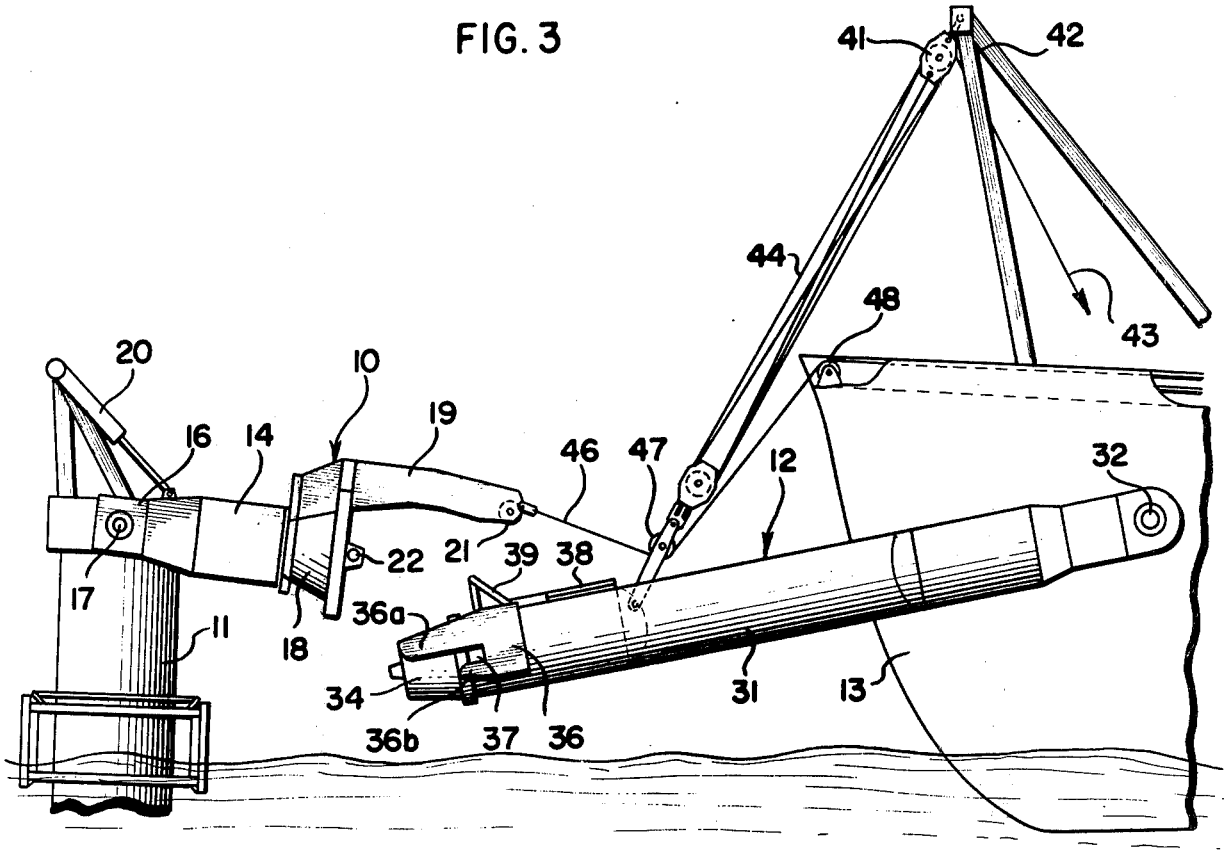
FIG. 3 shows the apparatus in a later stage of the mooring operation, in which the interlocking ends of the mooring elements are approaching operative position.
Figure 4:
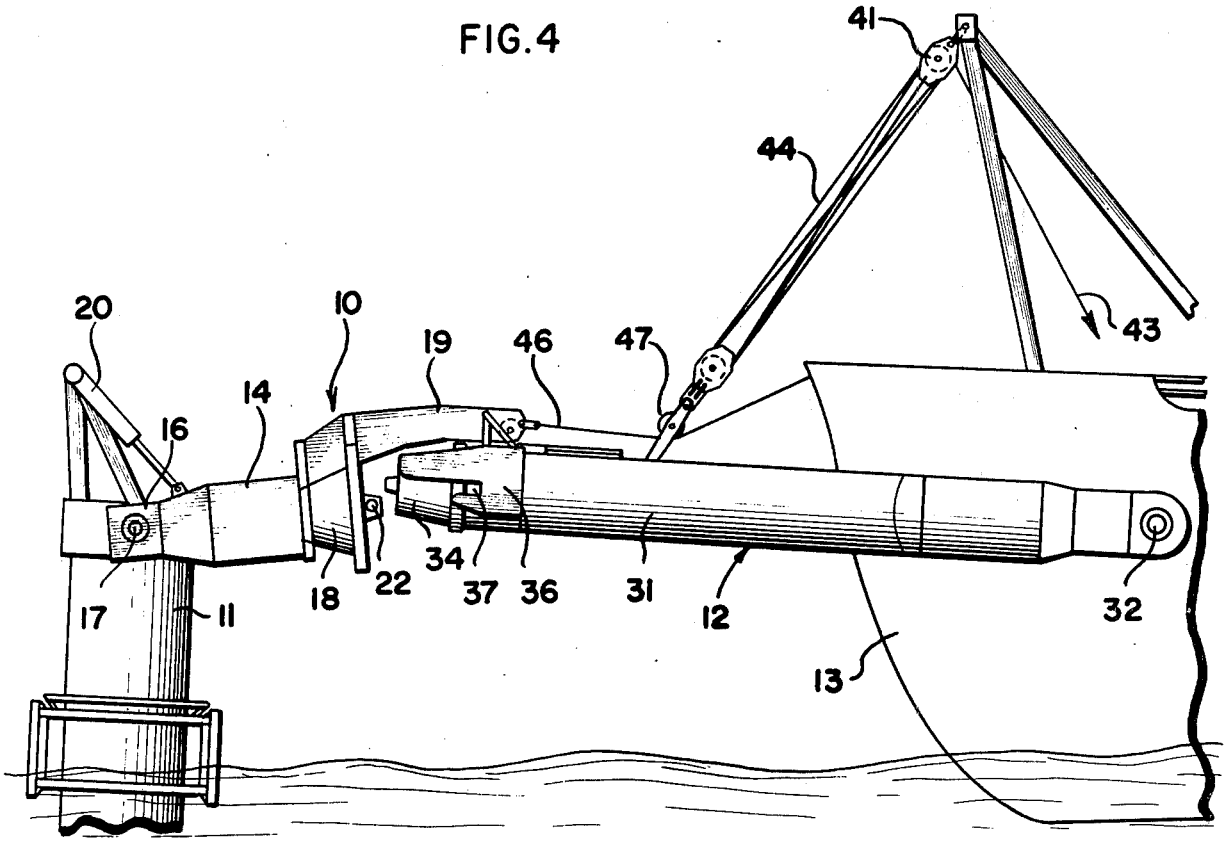
FIG. 4 shows a subsequent stage in the operation.

The operation of the system of the invention is illustrated in FIGS. 2–6. As shown in FIG. 2, the initial step in the operation is the attachment of connecting line 46 from ship 13 to the end of tower yoke alignment arm 19 as shown. The ship is caused to approach the mooring station by winching in the connecting line, while at the same time maintaining a tension thereon by means of one or more tug boats operatively connected to the stern of the ship which exert a force directly astern. Alternatively, it may be possible under some wind and wave conditions to achieve the desired tension in the connecting line by means of the ship's own screws operating in a reverse mode. In most cases, however, the use of auxiliary tugboats is desirable.

Figure 5:
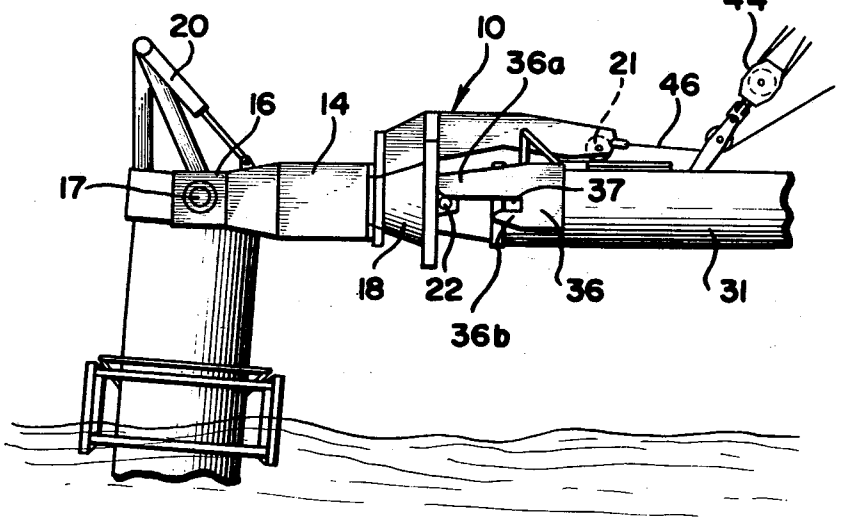
FIG. 5 shows the start of the final hook-up, as the locking ends of the yokes are guided into position.

With a rearward force exerted on the stern of the ship, alignment arm 19, connecting line 46 and ship yoke 12 will become collinear. By winching in the connecting line 46 the bow of the ship will approach the mooring station with the elements of the mooring system in alignment. Eventually, the condition shown in FIG. 3 will be reached, with the free end of ship yoke 12 in a position directly below tower yoke alignment arm 19 and with both the tower yoke and the ship yoke depressed below the horizontal. At this time, ship yoke 12 is elevated by block and tackle 41, causing tower alignment arm wheel 21 to contact bearing plate 38, thus elevating the tower yoke to the position shown in FIG. 4, with the overhanging portion of upper alignment member **36*a* above alignment pin 22, and with alignment arm 19 nestled between spaced guide frames 39. By continued retraction of connecting line 46 with simultaneous lowering of ship yoke 12, the condition shown in FIG. 5 is reached, in which the free ends of ship yoke alignment member 36*a* rest on alignment pins 22 on the tower yoke assembly 10 and with male cone 34 on the ship yoke aligned with and in a position to enter female cone 18** on the tower yoke.

Figure 6:
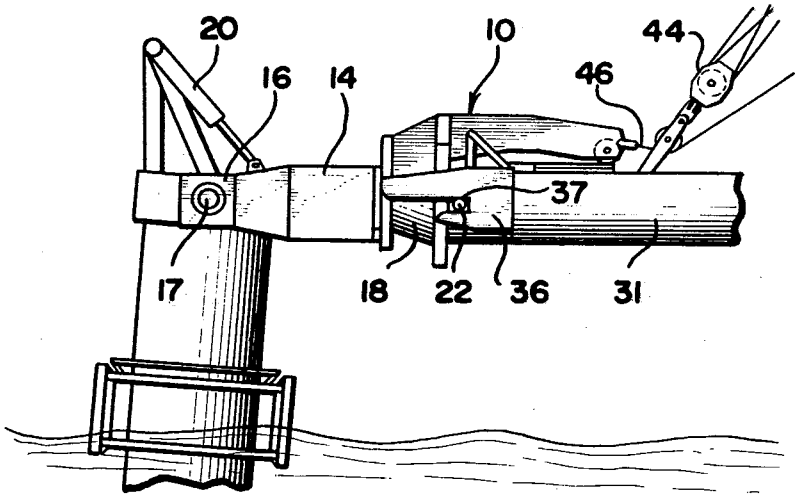
FIG. 6 shows the locked condition of the yoke assembly.

Continued winching of connecting line 46 will cause male cone 34 to enter female cone 18, as shown in FIG. 6, with the alignment pins 22 nestled within slots 37 of alignment arms 36. At this point, a suitable locking arrangement, e.g., retractable shear pins which extend out of cone 34 into mating depressions in cone 18, can be energized to interconnect the male and female cones in any desired manner to achieve a rigid interconnection between the tower yoke and the ship yoke. Suitable mechanical arrangements for achieving the connection between the cones 34 and 18 will be apparent to those skilled in the art. A particular locking assembly which is suitable for this purpose is described in the copending application Ser. No. 837,689, filed Sept. 29, 1977.

For disconnecting the ship from the tower, the procedure is essentially reversed, after unlocking male cone 34 from female cone 18.

The purpose of hydraulic rams 20 is to support tower yoke assembly 10 in a desired position before the connection to ship yoke 12 is made, to act as a shock absorber as the moving ship yoke bumps the tower yoke, and to support the tower yoke when the ship disconnects. After the ship yoke is locked into the tower yoke, the rams are operated in a "free-wheeling" mode which permits the tower yoke to swing up and down freely to accommodate movements of the ship. When the ship is about to disconnect, the rams are operated in a different mode which permits the tower yoke to move downward only under a force greater than that produced by the weight of the tower yoke alone. Thus, when the ship pushes the tower yoke down, it will move down, but when the ship is disconnected and pulled away, the yoke will not fall under its own weight and damage the tower. A mechanical counterweight system can be used in place of the hydraulic system described, to support the unbalanced weight of the tower yoke. Other arrangements will be apparent to those skilled in the art.

The foregoing detailed description has been given for clearness of understanding only, and no unnecessary limitations should be understood thereform, as modifications will be obvious to those skilled in the art.

What is claimed is:

1. A "quick-disconnect" mooring system for connecting a floating vessel to a buoyant mooring tower comprising:

an elongated tower yoke having one end adapted to be connected to said tower in a manner which permits said yoke to rotate about vertical and horizontal axes passing through the point of attachment to said tower, the other end of said tower yoke being provided with a first element of a two-element mechanical locking system;

a ship yoke having a pair of spaced arms, one end of each of which is adapted to be attached to opposite sides of the bow of a vessel for rotation about a horizontal axis, and a base interconnecting the other ends of said arms, said base having attached thereto the second element of said locking system;

said first and second locking elements being engageable to provide a rigid interconnection therebetween;

means on said vessel for controlling the elevation of the base of said ship yoke;

an elongated flexible cable having one end attached to said first locking element and the other end operatively attached to a take-up system located on said vessel;

means on said ship yoke engaging said cable for aligning said cable and said yoke when said cable is taut;

whereby the two elements of said locking assembly can be brought into aligned operative engaging relationship by taking up said cable in a taut condition.

2. A mooring system in accordance with claim 1 wherein:

said first mechanical locking element comprises a horizontal tower yoke alignment arm projecting toward said vessel, a female locking cone situated below said tower yoke alignment arm, and a pair of alignment pins situated on said female cone below said alignment arm and projecting outwardly in a direction transverse to the axis of said alignment arm; and the second element of said disconnect system comprises a male locking cone adapted to nest within and interlock with said female cone, a pair of ship yoke alignment arms arranged on opposite sides of said male cone, spaced from and extending in a direction parallel to the axis of said male cone, each of said ship yoke alignment arms having a rearwardly extending slot adapted to receive one of said alignment pins;

the free end of said tower yoke alignment arm being positioned to bear on the upper surface of said base when said pins are received in said slots and said male and female cones are aligned for interlocking; and means for interlocking said cones when nested.

3. The mooring system of claim 2 which is further provided with a rotatable wheel at the free end of said tower yoke alignment arm, and a horizontal bearing plate on the upper surface of said base, said wheel bearing on said plate when said male and female cones are aligned and in position for nesting.

4. A mooring system in accordance with claim 2 wherein each of said ship yoke alignment arms comprises upper and lower elongated members joined at one end to define said slot, the length of said upper member being greater than that of said lower member, whereby the free end of said upper member overhangs the free end of said lower member.

* * * * *